US008490971B2

(12) United States Patent
Ouwerkerk et al.

(10) Patent No.: US 8,490,971 B2
(45) Date of Patent: Jul. 23, 2013

(54) AUTONOMOUS WIRELESS DIE

(75) Inventors: Martin Ouwerkerk, Eindhoven (NL); Ronaldus Maria Aarts, Eindhoven (NL); Natasha Kravtsova, Eindhoven (NL); Evert Jan Van Loenen, Eindhoven (NL); Daniel Willem Elisabeth Schobben, Eindhoven (NL); Bartel Marinus Van De Sluis, Eindhoven (NL); Maarten Peter Bodlaender, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 1619 days.

(21) Appl. No.: 11/577,737

(22) PCT Filed: Oct. 19, 2005

(86) PCT No.: PCT/IB2005/053420

§ 371 (c)(1),
(2), (4) Date: Apr. 23, 2007

(87) PCT Pub. No.: WO2006/046169

PCT Pub. Date: May 4, 2006

(65) Prior Publication Data

US 2009/0104976 A1 Apr. 23, 2009

(30) Foreign Application Priority Data

Oct. 25, 2004 (EP) ..... 04105266

(51) Int. Cl.
*A63F 9/04* (2006.01)

(52) U.S. Cl.
USPC ..... 273/146; 273/138.2; 463/22

(58) Field of Classification Search
USPC ..... 463/22; 273/138.2, 146
See application file for complete search history.

(56) References Cited

U.S. PATENT DOCUMENTS

| | | | | |
|---|---|---|---|---|
| 4,034,988 | A * | 7/1977 | Goldner et al. | 463/22 |
| 4,641,840 | A * | 2/1987 | Larson | 463/22 |
| 4,858,931 | A * | 8/1989 | McKechnie | 463/22 |
| 5,583,436 | A * | 12/1996 | Van De Walle et al. | 324/252 |
| 5,651,548 | A | 7/1997 | French et al. | |
| 5,694,045 | A * | 12/1997 | Ikeda et al. | 324/652 |
| 6,220,594 | B1 * | 4/2001 | Peng | 273/146 |
| 6,252,335 | B1 * | 6/2001 | Nilsson et al. | 310/328 |
| 6,331,145 | B1 | 12/2001 | Sity et al. | |

(Continued)

FOREIGN PATENT DOCUMENTS

| | | |
|---|---|---|
| EP | 0701848 | 3/1996 |
| FR | 2759919 | 8/1998 |

(Continued)

OTHER PUBLICATIONS

"XSENS Motion Technologies", http://www.xsens.com/index_google.htm.

*Primary Examiner* — Dmitry Suhol
*Assistant Examiner* — Jay Trent Liddle

(57) ABSTRACT

A wireless die (2) comprises an orientation detector (4) for determining an orientation of the die (2) and a transmitter (5) connected to the orientation detector (4) for transmitting die (2) orientation data to the receiver (3). The orientation detector (4) comprises at least two electromechanical detectors (6), the electromechanical detectors (6) being arranged for generating electrical power for the orientation detector (4) and transmitter (5), and for supplying gravity based orientation data.

16 Claims, 4 Drawing Sheets

U.S. PATENT DOCUMENTS

| | | | | |
|---|---|---|---|---|
| 6,394,903 | B1 * | 5/2002 | Lam | 463/22 |
| 6,605,939 | B1 * | 8/2003 | Jansseune et al. | 324/207.16 |
| 7,017,905 | B2 * | 3/2006 | Lindsey | 273/146 |
| 7,334,791 | B2 * | 2/2008 | Lindsey et al. | 273/146 |
| 2001/0052771 | A1 * | 12/2001 | Jagiella | 324/207.16 |
| 2002/0070635 | A1 | 6/2002 | Morrison et al. | |
| 2003/0064774 | A1 | 4/2003 | Fujimoto et al. | |
| 2004/0007942 | A1 | 1/2004 | Nishida et al. | |
| 2005/0164778 | A1 * | 7/2005 | Cooney | 463/22 |
| 2005/0215312 | A1 * | 9/2005 | Tresser et al. | 463/22 |

FOREIGN PATENT DOCUMENTS

| | | |
|---|---|---|
| JP | 2000084241 | 3/2002 |
| WO | 02003856 | 1/2002 |
| WO | 02095908 | 11/2002 |

* cited by examiner

AUTONOMOUS WIRELESS DIE

FIELD OF THE INVENTION

The present invention relates to a wireless die comprising an orientation detector for determining an orientation of the die and a transmitter connected to the orientation detector for transmitting die orientation data to the receiver.

The present invention further relates to a wireless die assembly comprising such a die and a receiver for receiving and reproducing a thrown value of the die.

BACKGROUND OF THE INVENTION

U.S. Pat. No. 6,331,145 describes dice which can detect a thrown value and use a wireless transmitter to communicate the thrown value to, e.g., a computer system, thus giving the user the "feel" and control over the dice throw, if compared to fully automated or computerized games where the computer determines a thrown value using a random number generator or the like. Disadvantages of this die are that the electrical components inside the die receive their operating energy from components that have a limited lifetime, such as a battery, from photo cells, which require a certain amount of light, often not available in gambling halls, or from the wireless receiving means, which requires an additional RF transmitter or the like.

A further drawback of the die in this document is that optical sensors, embedded in each face of the die (or in all faces except one), are used to determine on which face of the die it rests, i.e. the thrown value corresponds to value of the face opposite to the face comprising the photo sensor that does not generate a photocurrent. Note that this die will not work properly on a (partially) transparent table hence restricting the different types of tables that can be used. In a further embodiment, the die uses capacitance sensors or induction coil sensors to determine the thrown value, this type of sensors also restricts the different types of tables that can be used and therefore the usability of this type of die.

SUMMARY OF THE INVENTION

The present invention seeks to provide a wireless die which is arranged to wirelessly transmit the thrown value of the die to a receiver and which overcomes the disadvantages of prior art systems.

According to the present invention, a wireless die is provided according to the preamble defined above, in which the orientation detector comprises at least two electromechanical detectors, the electromechanical detectors being arranged for generating electrical power for the orientation detector and transmitter, and for supplying gravity based orientation data.

This offers a die which is self-sufficient in terms of its energy demands. The die is very practical (e.g. does not need any maintenance) and cheap because battery-replacement is not needed. The use of the electromechanical detectors for energy harvesting and orientation detection further reduces complexity of the design and manufacturing cost which are additional advantages. Furthermore, the use of gravity action to determine orientation is very reliable.

The electromechanical detectors comprise micro-machined cantilevers with piezoelectric sensors, in a further embodiment, which is a well-understood, reliable and physically small technology and therefore well-suited to fit in a wireless die according to the present invention.

In a further embodiment, the electromechanical detectors comprise a magnet element movable in one direction in combination with a sensing coil. This is a very simple, reliable and cheap implementation of the electromechanical detectors.

In an even further aspect of the invention, the receiver is arranged to detect a rolling state or rest state of the die from electromagnetic radiation from a sensing coil. By implementing the ability to detect a rolling state or rest state in the receiver, the validity of a throw can be ensured.

In a further aspect of the invention, the orientation detector is arranged to energize one sensing coil after detecting a rest state of the die, in order to generate an orientation specific electromagnetic signal. This allows the determination of the thrown value from the measured magnetic field and the prior knowledge of the position of the sensing coils inside the die.

The sensing coils are arranged for picking up energy from an external electromagnetic field in a further embodiment. This ensures that a certain minimum amount of electrical energy is available in the die which increases the user-friendliness.

In a further embodiment, an indicator is connected to the electromechanical detectors for indicating sufficient available energy. The indicator may provide an audio signal or a visual signal (for example emit light from each plane of a die) when the die is charged with sufficient energy. This helps to reduce the probability of occurrence of a non-valid throw.

The wireless die assembly comprises, in an even further embodiment, a state detector for detection of a rolling state or a rest state of the die. The state detector can be advantageously used to determine whether a roll is valid.

In a further aspect of the invention, the state detector detects a rolling state when die orientation data changes a certain minimum number of times in a first predetermined time period, $T_1$, and a rest state when the orientation data does not change for a second predetermined time period, $T_2$, after detection of a rolling state.

The state detector changes the state from rest to rolling state after detection of a predetermined magic sequence of operations.

In a further embodiment, the state detector is external to the die which allows a simplified design of the internals of the die.

The state detector is inside the die, in a further embodiment, which reduces the requirements for the bandwidth of the transmitter and the receiver because the orientation data does not need to be transmitted from the transmitter to the receiver during a roll in order to allow the receiver to determine the state of the die.

In a further embodiment, the wireless transmitter is only energized in a rest state after a rolling state. This allows the minimization of the use of the transmitter to a minimum.

The receiver comprises a controller, in a further embodiment, the controller being arranged for controlling output options on the die. This enables the use of audible or visual output means on the die which increases the enjoyment of playing with the die.

The wireless transmitter is arranged to transmit an identifier of the die, in a further embodiment of the present invention. This enables to use a plurality of dice according to the present invention and connect the values thrown with a certain die to a certain player. A further advantage of this embodiment is that the randomness of the die can be monitored, in order to guarantee fair play as much as possible.

According to a further aspect of the present invention, the die comprises a further input. This input may be used for various purposes, such as powering on the die or for selecting a predetermined play mode.

The present invention is advantageously used as part of a game. The aforementioned advantages can be enjoyed by players while playing the game.

BRIEF DESCRIPTION OF THE DRAWINGS

Embodiments of the invention will now be described, by way of example only, with reference to the accompanying schematic drawings in which corresponding reference symbols indicate corresponding parts, and in which.

DETAILED DESCRIPTION OF THE PREFERRED EMBODIMENTS

Figure 1:
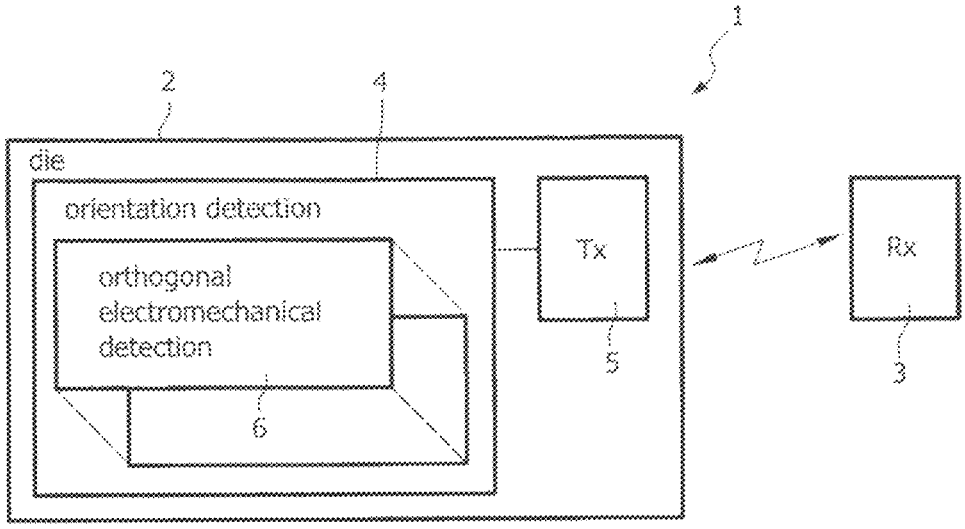
FIG. 1 shows a schematic block diagram of a wireless die according to an embodiment of the present invention.

FIG. 1 schematically shows a wireless die assembly 1 according to an embodiment of the present invention.

The wireless die assembly 1 comprises a die 2 which comprises an orientation detector 4. The orientation detector 4 is further connected to at least two electromechanical detectors 6 and to a wireless transmitter 5. A receiver 3 receives a wireless signal from wireless transmitter 5 and displays a thrown value of the die 2.

The die 2 may e.g. be a cube with six surfaces, each of which represents e.g. an integer in the range from 1 to 6 or a letter. The die 2 may be made of any appropriate type of commercially available material that can be used for regular dice, however, it will be clear to the person skilled in the art that the type of material needs to accommodate the type of wireless transmission that is used by the transmitter 5 and the receiver 3 of the wireless die assembly 1 and also with the type of the electromechanical detectors 6 that are used. For example, the die 2 should not substantially block electromagnetic radiation since it would hamper the wireless transmission from transmitter 5 to receiver 3. In a further embodiment of the invention, the die may not be a cube, but an octahydrogon (i.e. a three-dimensional eight sided object), for example.

The orientation detector 4 is arranged to receive the shaking, rolling and gravity based orientation data of the die 2 from the at least two electromechanical detectors 6 and determine the orientation of the die 2. The orientation detector 4 may further be arranged to determine the thrown value, i.e. the value on the top face of the die 2 in rest after a valid throw (i.e. spinning of the die 2 would be considered as an in-valid throw), from the gravity based orientation data. In a further embodiment, the orientation detector 4 may provide the orientation data to transmitter 5 for wirelessly transmitting to receiver 3. The orientation detector 4 may comprise digital processing circuits, analogue processing circuits or a combination of both, and may be operating under software instructions. Furthermore, the orientation detector 4 may comprise any type of data storage, such as, but not limited to, RAM, etc., for storing the software instructions.

The wireless transmitter 5 receives the orientation data from the orientation detector 4 and wirelessly transmits it to the wireless receiver 3. In a preferable embodiment, the wireless transmitter 8 comprises a low-power, small and lightweight wireless transmitter, e.g. a piezo radio transmitter such as disclosed in patent publication WO02/095908. The receiver 3 is arranged for receiving the wireless signal from the wireless transmitter 5 and may e.g. comprise digital processing circuits, analogue processing circuits or a combination of both, and may be operating under software instructions. The receiver 3 may comprise any type of data storage, such as, but not limited to, RAM, etc., for storing the software instructions. In an advantageous embodiment, the receiver 3 comprises e.g. a PC (Personal Computer) which is running a game program that is played by one or more players and which uses the thrown value of the die as one of the random input parameters of the game to determine its course.

The electromechanical detectors 6 are arranged to convert mechanical energy from the shaking and rolling movements of the die 2, such as e.g. during shaking, rolling or spinning of the die 2, into electrical energy for providing power to the orientation detector 4 and the wireless transmitter 5. The electromechanical detectors 6 are further arranged to provide orientation data to the orientation detector 4 for determining the thrown value of the die 2. In an advantageous embodiment, the electromechanical detectors may comprise sensors arranged substantially in a plane, the sensors being arranged to provide an electrical signal corresponding to a deflection from an equilibrium position and the deflection of the sensors depending on the orientation of the plane with respect to the gravitational field of the earth. For example, the orthogonal electromechanical detectors 6 may be arranged inside the die 2 such that the position of the plane is fixed with respect to the die 2. In this case, the sensors may have three possible states with respect to the plane, i.e. positive (sensor up with respect to the plane), negative (sensor down with respect to the plane) and zero (sensor aligned with the plane), depending on the orientation of the die 2. In the case of a die 2 comprising a cube with six planes, if one such electromechanical detector 6 is arranged in the die 2 such that a first axis in the plane of the sensors is parallel with one of the ribs of the die 2 and a second axis, which is perpendicular to the first axis and in the plane of the sensors, is not, and further a second such electromechanical detector 6 is arranged in the die 2 such that a first axis in the plane of the sensors is parallel with another one of the ribs of the die 2 which is perpendicular to the aforementioned rib of the die 2, and a second axis, which is perpendicular to the first axis and in the plane of the sensors, is not, then only two electromechanical detectors 6 are sufficient to determine the thrown value of the die 2. In a further advantageous embodiment, the planes of the die 2 may not be orthogonal (for example if die 2 comprises a three-dimensional octahydrogon or a three-dimensional octahedron, i.e. an octahedral object, or a three-dimensional dodecahydrogon) and the die 2 may comprise three orthogonal electromechanical detectors 6, in order to be able to provide the fill three-dimensional orientation data of the die 2 to the orientation detector 4.

Figure 2:
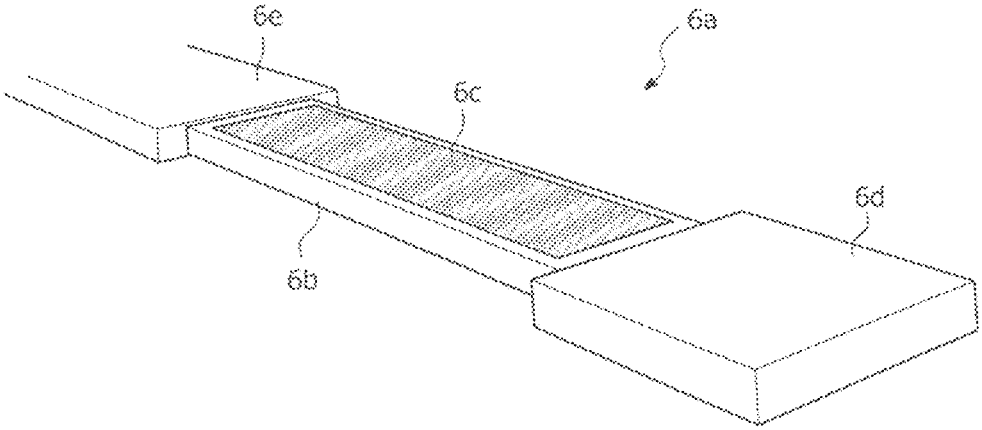
FIG. 2 shows a schematic illustration of a piezoelectric cantilever arrangement according to an embodiment of the present invention.

In a preferred embodiment, the electromechanical detectors 6 may comprise an array of micro-machined cantilevers, each cantilever being attached to a piezoelectric element (also called micro-generators). FIG. 2 shows a schematic illustration of a micro-machined cantilever 6*a* according to an embodiment of the present invention. The micro-machined cantilever 6*a* comprises a rectangular beam 6*b*, the rectangular beam 6*b* comprising a piezoelectric layer 6*c*, one end of the rectangular beam 6*a* being attached to a mass 6*d* and the other end of the rectangular beam 6*b* being attached to an end 6*e* which is fixedly attached to the die 2. The micro-machined cantilever 6*a* is arranged to deflect from its equilibrium position in the presence of vibration energy or a gravitational field and produces stress in the piezoelectric layer 6*c*. As the rectangular beam 6*b* is attached at one end, the movement of the mass 6*d* corresponds to a part of an arc, which corresponds to substantially one direction in relation to the die structure. The piezoelectric layer 6*c* converts the mechanical stress into an electrical voltage and this arrangement is therefore suitable to convert the deflection of the mass 6*d*, due to e.g. the shaking and rolling of the die, into electrical energy that can be used to supply electrical power to the different electrical components in die 2 of the wireless die assembly 1.

The receiver 3 is arranged, in a further advantageous embodiment, to detect a rolling or rest state of the die 2 comprising sensing coils and magnet elements. In an exemplary embodiment, the receiver 3 may be arranged to receive a magnitude and direction of magnetic fields provided by the magnet elements in the sensing coils in the die 2 and determine whether a player is shaking die 2, or whether the die 2 is shaking, rolling, spinning or in a rest state.

In a further embodiment, the electromechanical detectors 6 for harvesting energy and determining the orientation of the die 2 comprise magnet elements which are movably positioned with respect to sensing coils, the sensing coils being arranged in a fixed position with respect to the die 2. The sensing coils may e.g. be inductive coils. In this case, the shaking and rolling of the die 2 will cause the magnet elements to move with respect to the inductive coils and change the magnetic flux comprised by the inductive coils hence inducing electrical currents in the inductive coils which can be used to power the electrical components in the die 2, such as e.g. the orientation detector 4 and the wireless transmitter 5. The orientation detector 4 is further arranged to alternately apply an electrical current to each inductive coil when the die 2 is in rest after a throw. A magnetometer measures the magnetic field of the die 2 and determines the thrown value from the direction of the measured magnetic field when the different currents are applied. For example, if three orthogonal inductive coils comprising movably positioned magnet elements are arranged inside the die 2, such that each inductive coil is arranged parallel to a rib of the die 2, only one inductive coil will generate a magnetic field with a substantial amplitude in the vertical direction (i.e. parallel to the normal of the playing table) when the die 2 is in rest after a throw. The sign of the substantially vertical magnetic field in combination with the prior knowledge of the positions and polarity of the coils with respect to the planes of the die 2 uniquely determine the thrown value of the die 2.

Figure 3:
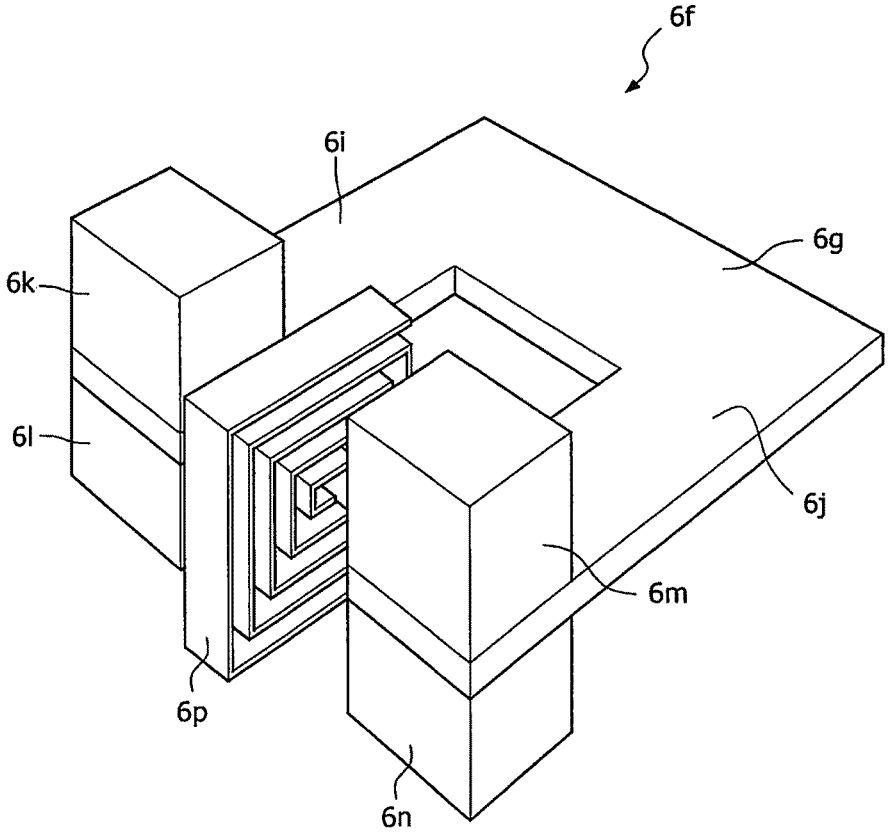
FIG. 3 shows a schematic illustration of an electromagnetic cantilever arrangement with sensing coil according to an embodiment of the present invention.

FIG. 3 shows a schematic illustration of an electromagnetic cantilever arrangement 6*f* according to an alternative embodiment of the present invention. The electromagnetic cantilever 6*f* comprises a U-shaped beam, the U-shaped beam comprising a base 6*g* being fixedly attached with respect to the die 2, and further comprising a first and second leg, 6*i*, 6*j*, a first end of the first leg and a first end of the second leg being fixedly attached to the base 6*h* of the U-shaped beam, a second end of each of the legs 6*i*, 6*j* being arranged to deflect from a equilibrium position in the presence of vibration energy from e.g. rolling and shaking of the die 2. A first pair of magnet elements 6*k*, 6*l* for generating a magnetic field is arranged to sandwich the second end of the first leg 6*i* and a second pair of magnet elements 6*m*, 6*n* for generating a magnetic field is arranged to sandwich the second end of the second leg 6*j*. A sensing coil 6*p* is being arranged fixedly with respect to the die 2 between the first and second pair of magnet elements 6*k*-6*n*, a winding axis of the inductive coil 6*p* being arranged parallel to the base of the U-shaped beam 6*h*. The sensing coil 6*p* may be an inductive coil for converting a magnetic flux from the two pairs of magnet elements 6*k*-6*n*, into electrical current. In a further embodiment, a first direction of the magnetic fields from the magnet elements 6*k*-6*n* is parallel to the winding axis of the sensing coil 6*p* and the sign of the magnetic field from the magnetic elements 6*k* and 6*m* is the same and opposite in sign to the sign of the magnetic field from magnet element 6*l* and 6*n*. The shaking and rolling of the die 2 will cause the magnet elements to move with respect to the inductive coils and change the magnetic flux comprised by the inductive coil hence changing the electrical current in the inductive coil which can be used to power the electrical components in the die 2, such as e.g. the orientation detector 4 and the wireless transmitter 5. The orientation detector 4 is further arranged to determine a sign of the electrical current through the sensing coil 6*p* of each electromagnetic cantilever 6*f* in the die 2 and determines the thrown value from the sign of the measured electrical current when the die 2 is in rest after a throw. For example, if three electromagnetic cantilevers 6*f* are arranged inside the die 2, such that the U-shaped beams of the three electromagnetic cantilevers 6*f* in the die 2 are orthogonal to one another and parallel to one of the planes of the die 2, the electrical current of one of the three inductive coils 6*j* will be substantially equal to zero which limits the possible thrown values to two. The orientation detector 4 then determines the thrown value from the sign of the electrical current in the two remaining inductive coils 6*p*. The sign of the electrical current in the two remaining inductive coils 6*p* in combination with the prior knowledge of the positions and polarity of the coils with respect to the planes of the die 2 uniquely determine the thrown value of the die 2. This embodiment is very fraud-proof since it is virtually impossible to manipulate the thrown value that is determined by the orientation detector by changing the magnetic field that is measured by the inductive coils 6*p* by using a magnet element external to the die 2.

The sensing coils are arranged for picking up an external magnetic field, in a further embodiment, and converting it to electrical energy for powering the electrical components in the die 2. By doing this, the die may be placed in a small charge unit, arranged for providing a magnetic field, so that the die 2 does not need to be charged by shaking prior to use but instead can be used immediately.

In a further embodiment, the electromechanical detectors 6 may further comprise power management means arranged to regulate the power supply to the different electrical components in the die 2. For example, in the embodiment where the electromechanical detectors 6 comprise micro-generators (where one micro-generator comprises a micro-machined cantilever with its piezoelectric element), the power management means may comprise a power processor electrically coupled to outputs of the plurality of micro-generators. The power processor can dynamically adjust its switching functions when the input conditions change (i.e. the vibration energy provided to the die 2 changes), in order to optimize the power delivered to a load, such as the orientation detector 4, or to an energy storage reservoir such as e.g. a small battery or a capacitor. In a preferable embodiment, the electromechanical detector 6 and the power management means may be monolithically integrated in a single crystal silicon substrate.

Figure 4:
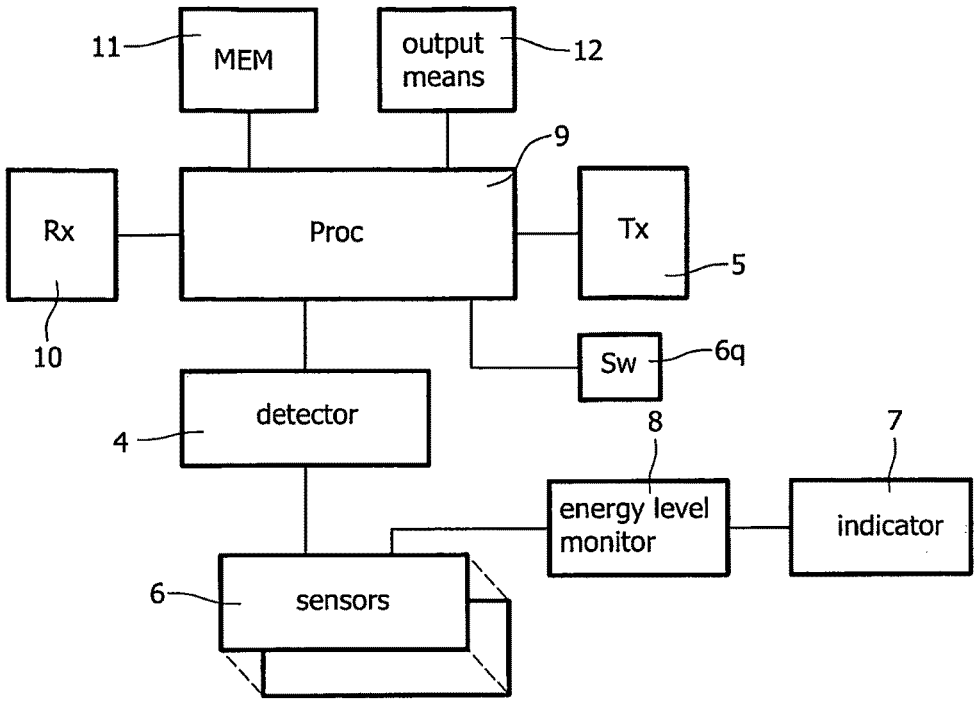
FIG. 4 schematically shows a wireless die according to an embodiment of the present invention.

FIG. 4 shows a schematic diagram of a die 2 for a wireless die assembly 1 according to an even further embodiment of the present invention. FIG. 4 shows a die 2 comprising an indicator 7 connected to an energy level monitor 8, the energy level monitor 8 connected to the electromechanical sensors 6. The die 2 further comprises a processing means 9 connected to the orientation detector 4, the wireless transmitter 5, a wireless receiver 10, a memory 11 and output means 12. In a preferred embodiment the memory 11 is a non-volatile memory.

The energy level monitor 8 is connected to the electromechanical sensors 6 for monitoring the harvested energy, in a preferred embodiment. The electromechanical sensors 6 may e.g. comprise an energy storage reservoir, e.g. a small battery or a capacitor, for storing the harvested electrical energy. The energy level monitor 8 is arranged to provide an energized signal to the indicator 7 if the level of harvested energy is sufficient to operate the different electrical components in the die 2 during a roll, subsequent detection of the thrown value and the transmission of the thrown value to the receiver 3 by the transmitter 5. This feature may be advantageous upon the beginning of a game when the energy level of the die 2 could be low and the player should shake the die 2 until the indicator 7 indicates that the energy level is sufficient and the player can then throw the die 2. The indicator 7 may comprise audio means for providing an audible signal to the player to indicate that the level of energy is sufficient to commence a roll with the die 2. In a further embodiment, the indicator may e.g. comprise visual means, e.g. an LED on each plane of the die 2, to indicate, e.g. by a short sequence of flashes, to the player that the die 2 is energized.

The wireless die assembly 1 may comprise a state detector, the state detector being arranged to detect a rolling, shaking or spinning state from a predetermined minimum number and type of orientation changes during a certain predetermined period of time $T_1$. The number of (90°) orientation changes of the die are tracked over time. The die state is changed to, for example, rolling, if a specified minimum number of orientation changes takes place within a specified interval. Note that this number depends on the size and shape of the die as well as on the weight of the die. For example, for a 8 $cm^3$ die (2 cm side), the orientation changes approximately four times per second when rolling, for a larger die the time can be longer. The throw counts as an official die roll if a number of requirements are met: sufficient rolling duration (e.g. >1 second), the rolling type is random enough (certain patterns of orientation changes do not count as correct die-rolls, e.g. spinning). The specific requirements may be configurable in application. If the die-roll passes the specified requirements, the orientation of the die after the throw may be provided to the wireless transmitting means by the processing means 9 for transmission to the wireless receiver 3 coupled to the controller 13. The state detector further detects a rest state in case of an absence of orientation changes during a certain predetermined period of time $T_2$.

In a further embodiment, erroneous die-roll events can be prevented from being measured e.g. while user is picking up the die, by manually completing a magic sequence of orientations prior to a throw in order to initiate the die-roll event. For example: the magic sequence 1-6-1-6 could initiate a roll of the die. Different magic sequences may also be programmed to make game-choices. In an even further embodiment, a game-choice may be made by hitting the die 2 on the table, which is characterized by an unchanged thrown value in combination with a sharp acceleration and deceleration of the electromechanical sensors 6.

Furthermore, the die may have a further input for performing a dedicated function. This is for example a buried switch 6*q* to allow a user to switch on the die.

Figure 5:
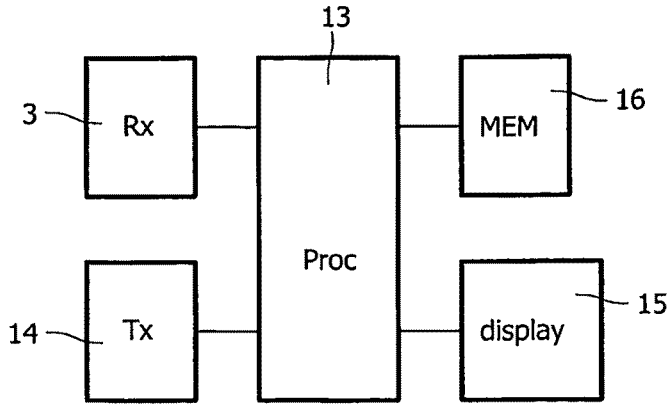
FIG. 5 is an illustration in process flowchart form of a method for detection and transmission of a thrown value of a die in accordance with the present invention.

FIG. 5 shows a receiver 3 for a wireless die assembly 1 according to another embodiment of the present invention. The receiver 3 is connected to a controller 13, the controller connected to a transmitter 14 and a display 15. The controller is arranged to provide output signals, for example the output value, to the transmitter 14 for transmission to receiver 10 in the die 2. The processing means 9 in the die 2 arranged for processing the output signal and displaying e.g. a thrown value on the output means 12 of die 2.

The state detector may be external to the die 2, in a further embodiment. For example, the state detector may be comprised in the controller 13 coupled to the receiver 3.

In a further embodiment, the processing means 9 may comprise the state detector, inside the die 2. The state detector may be implemented in hardware or in software instructions in the memory 11 of the processing means 9 in the die 2. In this embodiment, the transmitter 5 may be energized to transmit the thrown value after the rest state is achieved after a valid throw, this will be an energy-efficient implementation.

In a further embodiment, several dice 2 may be used in a game and the memory 11 of each die 2 comprises a unique identifier. The identifier may be transmitted to the receiver 3 and the controller 13 is arranged to identify which die 2 sent the thrown value to the receiver 3 and credits the appropriate player with the received thrown value. Also, the randomness of each of the dice 2 can be monitored in order to ensure fair competition between the players. The outer surface of the die 2 may be color-coded, in a further embodiment, so that the players can visually determine which of the dice 2 is their die 2. In a further embodiment, the wireless transmitter 5 in the die 2 comprise six RFID (Radio Frequency Identifier) tags of which only the RFID tag that corresponds to the thrown value is enabled by the processing means 9 after the rolling action is completed. Subsequently, the die 2 is interrogated by an RFID interrogator in the receiver 3.

The controller 13 may be arranged, in a further advantageous embodiment, to provide predetermined 'magic' sequences to the transmitter 14 for transmission to the receiver 10 of the die 2. The processing means 9 may be arranged for storing the magic sequences in the memory 11, for comparing the orientation data from the orientation detector 4 to the magic sequences, and providing a predetermined signal, such as a magic sequence indicator, to the transmitter 5 for transmission to the receiver 3. By doing this, controller 13 may initiate certain game choices.

The display 15 may be arranged to render an animation of one or more dice 2. The quality of the graphics representing the dice 2 on the display varies from six LEDs to a full 3D (three-dimensional) animation of the dice 2. As an alternative to displaying the thrown value of the die, the value could be reproduced acoustically, e.g. through speech synthesis.

In a further embodiment, the die 2 comprises output means 12 connected to the processing means 9, the output means 12 being arranged for receiving the thrown value from the processing means 9 and rendering them observable by the player(s). The output means 12 may provide an audio signal which clearly indicates the thrown value. This embodiment is particularly attractive for the visually impaired. In a further embodiment, the output means may show the thrown value on mini displays which are mounted on the different faces of the die 2. By doing this the user of the die can immediately observe the thrown value which increases the entertainment of the user when playing with the die.

Figure 6:
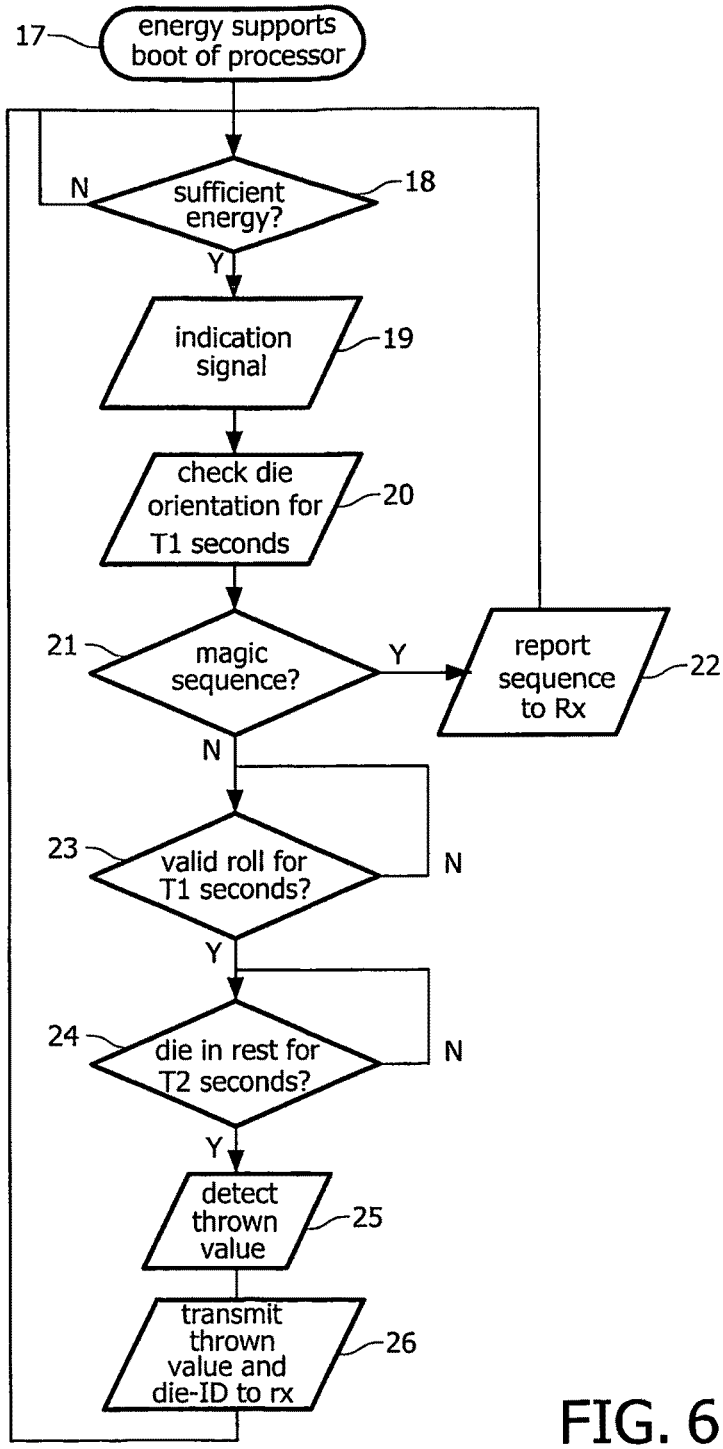
FIG. 6 is an illustration of a process flow diagram of a method for die-roll detection in accordance with an exemplary embodiment of the present invention.

FIG. 6 is an illustration of a process flow diagram of a method for die-roll detection in accordance with an exemplary embodiment of the present invention. The method starts at block 17 when sufficient electrical energy was available to complete a startup of the processing means 9 in the die 2. The required electrical energy may be generated by shaking the die 2 and converting the mechanical energy into electrical energy as described above, or by inductive coils inside the die 2 which pick up from an external magnetic field. At function block 18, the processing means 9 check whether the sum of the current energy level and the minimum harvesting energy from a roll of the die 2 is sufficient to supply the energy needed for the determination of the thrown value after a roll, providing the thrown value to the transmitter 5 and subsequent transmission of the thrown value to the receiver 3. The procedure continues to loop back to block 18 if the energy level does not meet the aforementioned criteria. Note that the die 2 may run out of energy if it is not shaken, rolled, spinned or has no external energy field to pick up energy from.

Next, the procedure monitors the orientation changes during a time period $T_1$ in block 20. The procedure checks at block 21 whether a magic sequence was entered by comparing the orientation data of the T seconds to magic sequences stored in the memory 11. If a magic sequence, for example a game choice, was manually entered by the player, the magic sequence is provided to the receiver 3 (block 22) and the procedure returns to block 18 and checks the energy. If no magic sequence was entered, the procedure continues to block 23 and checks whether the roll was valid or whether the player was merely shaking or spinning the die 2.

It is noted that the blocks 20-22 of FIG. 4 are optional steps, which may be left out in a specific embodiment.

If no valid roll was completed, the procedure loops back to block 23 and continues to check whether a valid roll was completed. Note that the memory 11 that stores the orientation data works as a shift register, continuously erasing the oldest orientation data, replacing it with the latest orientation data, and the processing means 9 determines the state of the die by analyzing the orientation data collected in the most recent time period $T_1$. If a valid roll is completed, the procedure continues to block 24 where the rest state is verified by checking whether the orientation data from the orientation detector 4 does not change for a predetermined time period $T_2$. If this is not the case, the procedure of function block 24 is repeated. If the die 2 is in rest state, the thrown value will be determined in block 25 and the thrown value of the die 2 and the identifier of the die 2 are transmitted to receiver 3.

It will be further appreciated by persons skilled in the art that the scope of the present invention is not limited by the embodiments that have been particularly shown and described herein above, but by the claims as attached hereafter.

The invention claimed is:

1. Wireless die comprising:

an orientation detector for determining an orientation of the die, a state detector detecting a rolling state or a rest state of the die by tracking a number and a type of orientation changes during a first predetermined time period, $T_1$; and a transmitter connected to the orientation detector for transmitting die orientation data to the receiver, wherein the orientation detector comprises at least two electromechanical detectors, the electromechanical detectors being arranged for generating electrical power for the orientation detector and transmitter, and for supplying gravity based orientation data.

2. Wireless die according to claim 1, in which the electromechanical detectors comprise micro-machined cantilevers with piezoelectric sensors.

3. Wireless die according to claim 1, in which the electromechanical detectors comprise a magnet element movable in one direction in combination with a sensing coil.

4. Wireless die according to claim 3, in which the orientation detector is arranged to energize the sensing coil after detecting a rest state of the die, in order to generate an orientation specific electromagnetic signal.

5. Wireless die according to claim 3, in which the sensing coil is arranged for picking up energy from an external electromagnetic field.

6. Wireless die according to claim 1, in which an indicator is connected to the electromechanical detectors for indicating sufficient available energy.

7. Wireless die according to claim 1, in which the die is arranged to only energize the wireless transmitter in a rest state after a rolling state.

8. Wireless die according to claim 1, in which the wireless transmitter is arranged to transmit an identifier signal of the die.

9. Wireless die according to claim 1, in which the die comprises a further input.

10. Wireless die assembly comprising a die according to claim 1 and a receiver for receiving and reproducing a thrown value of the die.

11. Wireless die assembly according to claim 10, in which the electromechanical detectors of the die comprise a magnet element movable in one direction in combination with a sensing coil, and in which the receiver is arranged to detect a rolling state or rest state of the die from electromagnetic radiation from the sensing coil.

12. Wireless die assembly according to claim 10, in which the receiver further comprises a state detector for detection of a rolling state or a rest state of the die.

13. Wireless die assembly according to claim 12, in which the state detector detects a rolling state when die orientation data changes a predetermined minimum number of times in the first predetermined time period, $T_1$, and a rest state when the orientation data does not change for a second predetermined time period, $T_2$.

14. Wireless die assembly according to claim 10, in which the state detector changes from rest state to rolling state after detection of a predetermined sequence of operations.

15. Wireless die assembly according to claim 10, in which the receiver is coupled to a controller, the controller being arranged for controlling output options on the die.

16. Game comprising at least one wireless die assembly as claimed in claim 10.

* * * * *